United States Patent [19]

Billgren

[11] Patent Number: 4,748,088

[45] Date of Patent: May 31, 1988

[54] TOOL DIE BLANK AND MANUFACTURING METHOD THEREOF

[75] Inventor: Per Billgren, Söderfors, Sweden

[73] Assignee: Kloster Speedsteel Aktiebolag, Söderfors, Sweden

[21] Appl. No.: 746,261

[22] Filed: Jun. 19, 1985

[30] Foreign Application Priority Data

Jun. 19, 1984 [SE] Sweden ..... 8403261

[51] Int. Cl.[4] ..... B22F 7/04

[52] U.S. Cl. ..... 428/558; 75/246; 76/101 R; 76/107 R; 76/DIG. 6; 419/8; 419/28; 419/29; 419/49; 428/638

[58] Field of Search ..... 419/8, 28, 29, 49; 75/246; 76/107 R, 101 R, DIG. 6; 428/558, 638

[56] References Cited

U.S. PATENT DOCUMENTS

| | | | |
|---|---|---|---|
| 2,515,589 | 7/1950 | Brauchler | 76/107 R |
| 3,803,702 | 4/1974 | Bratt et al. | 419/8 |
| 3,824,097 | 7/1974 | Smythe et al. | 75/226 |

*Primary Examiner*—Stephen J. Lechert, Jr.
*Attorney, Agent, or Firm*—Murray and Whisenhunt

[57] ABSTRACT

The invention relates to a blank for a tool die, made of compound steel with a core of high speed steel and a surrounding ring of a different steel, said ring bringing about a prestress in the core. According to the invention, the prestress is due to the fact that the core consists of a high speed steel powder which has been compacted to full density, that the ring consists of a steel alloy, the residual austenite transformation to martensite and consequent volume increase of which is zero or considerably less than the residual austenite transformation to martensite of the high speed steel after the same heat treatment, and that the blank has been hardened and tempered to create in the core a compression stress as a result of the obstruction by the surrounding ring of the volume increase of the core.

The invention relates also to a method for manufacturing such blanks. A high speed steel powder is filled into a thick-walled pipe, said pipe consisting of a steel different from high speed steel. The pipe is closed and subjected to hot isostatic compaction causing the high speed steel powder to become compacted to full density, forming a compact core in the pipe, so that a compound material is obtained. The pipe is cut into several discs or pieces of suitable lengths. The material is hardened and tempered, the high speed steel core during heat treatment undergoing a greater residual austenite transformation into martensite than the surrounding ring, a compression stress thus being created in the core.

16 Claims, 1 Drawing Sheet

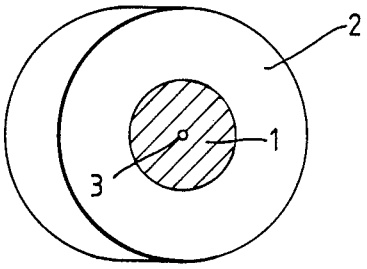
2
1
3

TOOL DIE BLANK AND MANUFACTURING METHOD THEREOF

TECHNICAL FIELD

The invention relates to a blank for a tool die made of a compound steel with a core of high speed steel and a surrounding ring of a different steel grade, said ring applying a prestress to the core. The invention relates also to a method for the manufacture of such blanks.

BACKGROUND ART

Many tools for forming or shearing purposes comprise a die, i e a cavity. Examples of such tool dies are punching dies, deep drawing dies, powder compaction dies, and cold extrusion dies. Other examples are drawing rings and extrusion dies. Such tools are often subject to strong radial forces, which could easily cause the die to crack. Therefore it is common practice to place the die inside a shrink ring to apply a prestress, a compressive stress, which may counteract the critical tensile stress occuring in the tool during work.

It is precision work to manufacture shrinkage fit dies. Both the core and the surrounding shrink ring must be turned and ground with extremely high precision (±7 μm). Such manufacturing is therefore expensive. Another drawback of this known technique is that the tool-manufacturer must purchase and stock bars of two different types of material, which have to be machined separately. The coursely machined die must then be sent away for heat treatment. Before shrink-fitting, the die must then be ground and adjusted to fit the shrink ring.

BRIEF DESCRIPTION OF THE DRAWING FIGURE

The drawing FIGURE illustrates a blank for a tool die comprising a core and a surrounding ring.

BRIEF DISCLOSURE OF THE INVENTION

The object of the invention is to solve the above problems, allowing the tool manufacturer to purchase one billet only instead of bars of two types of material, and not having to machine these separately. Another object is to eliminate the need for shrink fitting including the machining operations associated therewith (turning, grinding, etc), required in the art to achieve the necessary precision.

The invention is based on the property of high speed steels of undergoing a considerably larger permanent volume expansion during tempering hardening than do low-alloy steels, such as carbon steels, low-alloy tool steels, construction steels, and hot-working steels. The volume expansion is a result of the transformation of residual austenite to martensite. The amount of residual austenite in high speed steels after hardening is normally about 20–30%, while the other steel types mentioned have a considerably lower residual austenite content after the same heat treatment, normally no more than 10%. Due to the face-centered structure and greater density of the austenite compared to the martensite with its non-cubic structure, the transformation of residual austenite to martensite normally results in a volume increase during tempering. With high speed steels this volume increase is about 0.5% (depending on composition and on heat treatment, mainly hardening temperature). According to the invention, the volume expansion is obstructed by enclosing the high speed steel core in the surrounding ring, which then subjects the core to a compression. Specifically, this effect is accomplished by filling high speed steel powder into a thick-walled tube (the outer diameter of the tube normally being at least twice the inner diameter thereof), said tube consisting of another steel quality than high speed steel, closing the tube and subjecting it to hot isostatic compaction, the high speed steel powder thereby being compacted to full density and forming a compact core inside the tube, a compound material thus being created; cutting the tube into several discs or lengths; and hardening and tempering the compound material before or after cutting, which would have caused the high speed steel core to expand more than the surrounding ring during annealing, had it been allowed to expand freely. Since this expansion is obstructed by the ring, the desired compressive stress is created.

Thus, the blank according to the invention consists of a core, which in turn consists of a powder high speed steel compacted to full density, and a surrounding ring, consisting of an alloyed steel, the residual austenite transformation and consequent volume increase of which is zero or at least considerably less than the residual austenite transformation of the high speed steel after the same heat treatment, said blank having been hardened and tempered the obstruction of the expansion of the core by the ring causing a compression stress in the core.

Further objects, advantages, and characteristics of the invention will become aparent from the appended claims and the following description of some illustrative embodiments. Reference will be made to the attached drawing, which shows a blank in accordance with the invention.

DESCRIPTION OF ILLUSTRATIVE EMBODIMENTS

A blank according to the invention consists of a compound material with a core 1 of a high-alloy powder steel (high speed steel) and (usually) a low-alloy material in the surrounding ring 2. Among possible high speed steels those which are marketed under the trade name ASP® may be chosen, for example, such as ASP® 23. The ring on the contrary consists of carbon steel, a low-alloy construction steel, or a hot-working steel containing no more than about 15% alloying elements. It is possible to let the surrounding ring consist of an austenitic steel, which will not expand either, in spite of the heat treatment, since it has an austenitic structure permanently.

The table below presents some possible combinations of alloys, percent by weight; balance iron and impurities in normal amounts.

| Material | C | Si | Mn | Cr | Mo | V | W |
|---|---|---|---|---|---|---|---|
| Core: | | | | | | | |
| ASP® 23 | 1.27 | | | 4.2 | 5.0 | 3.1 | 6.4 |
| Ring: | | | | | | | |
| STRUCTO 890 | 0.40 | 0.25 | 0.80 | 1.0 | 0.30 | | |
| H 11 | 0.35 | 1.00 | 0.30 | 5.0 | 1.50 | 0.40 | |
| K 326 | 0.43 | 0.60 | 0.60 | 3.2 | 0.7 | 0.3 | |

The blanks are manufactured according to the following procedure: High speed steel powder is filled into a pipe, which is to become the ring of the finished blanks. The inner diameter of the pipe is approximately equal to ⅓ of its outer diameter. The central pipe, if there is one, is thin-walled and has an inner diameter of appr. 3 mm. The outer pipe is closed at both ends, suitably by welding gables thereto. The inner pipe, if there is one, is arranged coaxially and extends through the two gables. The capsule thus made is then subjected to hot isostatic compaction according to prior art, the external pipe thereby being compressed and compacting the high speed steel powder to full density. After cooling, the pipe with its content is soft annealed and then cut into discs or suitable lengths. The discs are turned externally and are possibly provided with a central bore 3, in case no central pipe has been fitted. The purpose of this central bore or pipe is to prepare the blank for later spark machining in connection with the manufacture of the die. The disc is then heat treated by heating to 1000°-1300° C. preferably to 1120°-1220° C., followed by air cooling to room temperature and tempering at 500°-600° C. Finally the blank thus prepared is surface ground, its core having been put under the desired prestress by the hardening and tempering treatment. The hardening gives a residual austenite content of 10-50%, preferably 20-30%, the residual austenite content of the surrounding ring being considerably less, i.e. no more than 10%. During the tempering following the hardening the residual austenite is transformed to martensite, which if expansion was not restricted would have resulted in a volume increase of 0.5%, but due to the presence of the outer ring instead causes a compression stress in the core. Should the ring be made of an austenitic material, the austenitic structure is retained without changes in volume.

I claim:

1. A method for manufacturing blanks for tool dies, having a prestressed core, comprising:

providing a pipe-like member of predetermined outside diameter having a hollow core of predetermined diameter, said pipe-like member formed of a steel having a first predetermined degree of residual austenite transformation into martensite during a tempering after a hardening;

providing a high speed steel powder, said high speed steel having a second predetermined degree of residual austenite transformation into martensite during said tempering after said hardening;

filling said hollow core of said pipe-like member with said high speed steel powder;

sealing said high speed steel powder in said hollow core of said pipe-like member;

subjecting said sealed pipe-like member to hot isostatic compaction causing the powder to become compacted to full density and forming a compact core within said pipe-like member, a compound material thus being created;

subjecting said compound material to said hardening and then said tempering, said first predetermined degree of residual austenite transformation into martensite being substantially less than said second predetermined degree of residual austenite transformation into martensite whereby a compression stress is induced in said core due to the larger volume of the martensite phase as compared to the austenite phase.

2. The method according to claim 1, further comprising cutting said pipe-like member containing said compact core into discs prior to said hardening and tempering.

3. The method according to claim 1, further comprising cutting said pipe-like member containing said compact core into discs subsequent to said hardening and tempering.

4. The method according to claim 1, wherein said outside diameter of said pipe-like member is at least twice said diameter of said hollow core.

5. The method according to claim 1, wherein said pipe-like member is formed of an alloyed steel.

6. The method according to claim 1, wherein said pipe-like member is formed of a carbon steel, a low carbon tool steel, a construction steel or a hot working steel, containing no more than 15% alloying elements in all.

7. The method according to claim 1, wherein said pipe-like member is an austenitic steel.

8. The method according to claim 1, wherein said hardening comprises heating to a temperature of between 1000° and 1300° C. and air cooling to room temperature.

9. The method according to claim 8, wherein said hardening comprises heating to a temperature of between 1120° and 1220° C. and air cooling to room temperature.

10. The method according to claim 1, wherein said hardening brings said residual austenite content of said high speed steel powder to between 10 and 50% by volume, said tempering takes place at 500°-600° C., and said residual austenite is transformed into martensite.

11. The method according to claim 10, wherein said hardening brings said residual austenite content of said high speed steel powder to between 20 and 30% by volume, said tempering takes place at 500°-600° C., and said residual austenite is transformed into martensite.

12. The product produced by the process of claim 1.

13. The product according to claim 12, wherein said high speed steel is martensitic, 10-50% of the martensite consisting of transformed austenite, transformed during tempering.

14. The product according to claim 12, wherein said high speed steel is martensitic, 20-30% of the martensite consisting of transformed austenite, transformed during tempering.

15. The product according to claim 12, wherein said pipe-like member comprises carbon steel, low carbon tool steel, construction steel, or hot working steel, containing no more than 15 weight % alloy elements and having a structure containing no more than approximately 19% martensite in the form of transformed residual austenite, transformed during tempering.

16. The product according to claim 12, wherein said pipe-like member comprises a stainless austenitic steel.

* * * * *